US007716960B2

(12) United States Patent
Tamezane et al.

(10) Patent No.: US 7,716,960 B2
(45) Date of Patent: May 18, 2010

(54) LOCK DEVICE

(75) Inventors: Takumi Tamezane, Aichi-ken (JP); Toshiharu Katagiri, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 487 days.

(21) Appl. No.: 11/773,173

(22) Filed: Jul. 3, 2007

(65) Prior Publication Data

US 2008/0006068 A1 Jan. 10, 2008

(30) Foreign Application Priority Data

Jul. 6, 2006 (JP) ..... 2006-186624

(51) Int. Cl.
*E05B 27/00* (2006.01)

(52) U.S. Cl. ..... 70/361; 70/387; 70/492; 70/495; 70/496; 292/DIG. 37

(58) Field of Classification Search ..... 70/360, 70/361, 387, 492, 495, 496; 292/DIG. 37
See application file for complete search history.

(56) References Cited

U.S. PATENT DOCUMENTS 957,938 A * 5/1910 Cox ..... 70/156
1,288,074 A * 12/1918 Lutz ..... 70/361
2,454,926 A * 11/1948 Jacobi ..... 70/84
2,683,978 A * 7/1954 Jacobi ..... 70/360
4,759,204 A * 7/1988 Neyret ..... 70/360
4,903,512 A * 2/1990 Leroy et al. ..... 70/379 R
4,905,487 A * 3/1990 Morikawa et al. ..... 70/186
5,265,453 A * 11/1993 Konii et al. ..... 70/379 R
5,640,864 A * 6/1997 Miyamoto ..... 70/379 R
5,722,275 A * 3/1998 Price et al. ..... 70/379 R (Continued)

FOREIGN PATENT DOCUMENTS

JP 5-59849 A 3/1993

(Continued)

*Primary Examiner*—Suzanne D Barrett
(74) *Attorney, Agent, or Firm*—Roberts Mlotkowski Safran & Cole, P.C.; Thomas W. Cole

(57) ABSTRACT

A lock device has: a cylindrical case member in which is formed a space extending in an axial direction; a cylindrical sleeve member is disposed at an interior of the case member, and is supported and configured to move along the axial direction between a predetermined standby position and an operating position; a plunger member which is disposed at an interior of the sleeve member and configured to move along the axial direction, and which is supported and configured to move between the standby position and the operating position, and in which a key insertion hole, which is for insertion of a key from an outer side at the standby position, is formed along the axial direction; a plurality of tumbler members disposed at the plunger member and configured to move along a direction orthogonal to the axial direction between proper positions, a side lock member disposed at the plunger member and configured to approach and move away from the tumbler members, and an interlocking mechanism which, at a time when the connection of the plunger member and the sleeve member is cancelled by the side lock member, when the plunger member becomes integral with a proper key and moves to the operating position, transfers pushing force from the plunger member to a mechanism to be operated.

4 Claims, 7 Drawing Sheets

U.S. PATENT DOCUMENTS 5,732,580 A * 3/1998 Garnault et al. ..... 70/422
5,765,417 A * 6/1998 Bolton ..... 70/495
6,098,434 A * 8/2000 Liou ..... 70/360
6,523,382 B1 * 2/2003 Dimig et al. ..... 70/496
6,761,052 B2 * 7/2004 Buschmann ..... 70/361
6,776,016 B1 * 8/2004 Wittwer et al. ..... 70/252

FOREIGN PATENT DOCUMENTS

WO 02/27124 A1 4/2002

* cited by examiner 10
92
118
100
96
46
98
38
94
20
34
36
40
116
30
32
108
106
104
112
26
110
102
128
66
126
124
122
120
76
23
44
28
22
16
48
18
42
14
12(121)
S
H
IIA
IIB

LOCK DEVICE

CROSS-REFERENCE TO RELATED APPLICATION

This application claims priority under 35 USC 119 from Japanese Patent Application No. 2006-186624, the disclosure of which is incorporated by reference herein.

BACKGROUND OF THE INVENTION

1. Field of the Invention

The present invention relates to a lock device which operates a mechanism to be operated such as a locking mechanism or the like which is the object of key operation by a key inserted in a key insertion hole, and which maintains the mechanism to be operated in a non-operating state.

2. Description of the Related Art

The structure disclosed in Japanese Patent Application Laid-Open (JP-A) No. 5-59849 is known as an example of a lock device provided at the door or the like of an automobile. This lock device has: a key cylinder provided rotatably within an accommodating hole of a cylindrical-tubular case; plural tumblers provided slidably within the key cylinder; a side bar which is provided slidably within the key cylinder, and approaches and moves away from the respective tumblers; and a lever member disposed so as to be able to rotate relative to the key cylinder, and connected to a lock device which is a mechanism to be operated.

In the above-described lock device, when a proper key, at which proper engaged portions are provided is inserted into the key cylinder, the plural tumblers engage respectively with the engaged portions provided at the key and slide to predetermined proper positions, and the side bar contacts predetermined abutting positions of all of the tumblers and moves from a locking position to an unlocking position. Interlockingly therewith, the side bar engages with the lever member and connects the key cylinder to the lever member. The key cylinder and the lever member thereby become integral and able to rotate. Due to the key being rotated, the locking mechanism which is the object of the key operation can be operated by the key.

On the other hand, when a substitute for the key, such as a key of a shape different than the proper key, or a screwdriver, or the like (these will be referred to collectively hereinafter as "improper keys") is inserted in the key cylinder, at least one of the tumblers does not slide to the proper position, and the side bar is maintained at the locking position. In this way, the side bar does not engage with the lever member, and the key cylinder is not connected to the lever member by the side bar. Therefore, even if the key cylinder is rotated via the key, torque is not transmitted to the lever member, and the locking mechanism which is the object of the key operation cannot be operated.

Namely, in the lock device disclosed in JP-A No. 5-59849, if a proper key having proper engaged portions is inserted into the key cylinder and all of the tumblers which engage respectively with the plural engaged portions at the proper key move to the proper positions, the locking mechanism can be unlocked by the proper key being rotated. However, in a case in which an improper key, which has improper engaged portions or at which engaged portions are not provided, is inserted into the key insertion hole, even if this improper key is forcibly rotated, due to the key cylinder rotating idly with respect to the lever member, the locking mechanism is not unlocked. Further, because excessive force is not applied to the respective structural parts, breakage of the structural parts is prevented.

However, in a lock device such as that described above, at the time of unlocking, the key (the proper key) must be rotated against the rotation resistance of the key cylinder and the lever member, the operation resistance of the locking mechanism, and the like, and the torque which is transmitted from the key to the key cylinder is quite large. Accordingly, in order to reliably prevent deformation of the key, the strength along the twisting direction of the key must be made to be sufficiently large. For this reason, the material of a key used in a lock device such as described above is limited to a material having relatively high strength, such as iron, stainless steel, or the like. Further, the thickness of the key must be made to be sufficiently thick in accordance with the magnitude of the transmitted torque.

In order to reduce the strength along the twisting direction which is required of the key small, a lock device has been conceived of which carries out unlocking by, rather than rotating a key which is inserted in a key insertion hole of the lock device, pushing the key. However, among lock devices which operate a locking mechanism by a pushing movement, there have not been any which can effectively prevent breakage of the structural parts even if an improper key is inserted into the key insertion hole and excessive force is applied via this improper key.

SUMMARY OF THE INVENTION

An object of the present invention is to overcome the above-described problems, and a first aspect for achieving this object relates to a lock device having: a case member which is cylindrical shaped and at whose interior is formed a space extending in an axial direction; a sleeve member which is cylindrical shaped, and is disposed at the interior of the case member, and is supported by the case member and configured to move along the axial direction between a predetermined standby position and an operating position; a plunger member which is disposed at an interior of the sleeve member and configured to move along the axial direction, and which is supported by the case member via the sleeve member and configured to move between the standby position and the operating position, and in which a key insertion hole, which is for insertion of a key from an outer side at the standby position, is formed along the axial direction; a plurality of tumbler members disposed at the plunger member and configured to move along a direction orthogonal to the axial direction between proper positions, which correspond to engaged portions of a proper key at which proper engaged portions are provided, and improper positions, which do not correspond to the engaged portions, and engaging concave portions are formed in peripheral edge portions of the tumbler members, and when a proper key is inserted into the key insertion hole of the plunger member, the tumbler members engage with the engaged portions of the proper key and move to the proper positions, and when an improper key, at which shapes of engaged portions differ from the proper key, is inserted, at least one of the tumbler members is at an improper position; a side lock member disposed at the plunger member and configured to approach and move away from the tumbler members, and when an improper key is inserted in the key insertion hole and at least one of the tumbler members is at the improper position, the side lock member moves apart from the engaging concave portions of the tumbler members and connects the plunger member and the sleeve member along the axial direction, and when a proper key is inserted in the key insertion hole and all of the tumbler members move to the proper positions, the side lock member engages with the engaging concave portions of all of the tumbler members and cancels connection of the plunger member and the sleeve member; and an interlocking mechanism which, at a time when the connection of the plunger member and the sleeve member is cancelled by the side lock member, when the plunger member becomes integral with a proper key and moves to the operating position, transfers pushing force from the plunger member to a mechanism to be operated which is an object of key operation, and causes the mechanism to be operated to operate, and, at a time when the plunger member and the sleeve member are connected together by the side lock member, the interlocking mechanism cuts-off transfer of the pushing force from the plunger member and maintains the mechanism to be operated in a non-operating state, even if the sleeve member is integral with the plunger member and an improper key and moves to the operating position.

In the lock device relating to the first aspect, when an improper key is inserted in the key insertion hole, the plunger member and the sleeve member are connected along the axial direction by the side lock member. Accordingly, when the operator pushes the improper key, which is inserted in the key insertion hole, toward the operating position, this pushing force is transmitted to the plunger member and the sleeve member via the improper key, and the plunger member and the sleeve member become integral with the improper key and move from the standby position to the operating position. However, when the plunger member and the sleeve member become integral with the improper key and move from the standby position to the operating position, the transfer of the pushing force from the plunger member is cut-off by the interlocking mechanism, and the mechanism to be operated is maintained in a non-operating state.

On the other hand, when a proper key is inserted in the key insertion hole, the connection of the plunger member and the sleeve member is cancelled by the side lock member. Accordingly, when the operator pushes the proper key, which is inserted in the key insertion hole, toward the operating position, the pushing force is transferred to the plunger member via the improper key, and is not transmitted to the sleeve member. Therefore, the sleeve member remains at the standby position as is, and only the plunger member becomes integral with the proper key and moves from the standby position to the operating position. Accordingly, the pushing force from the plunger member is transmitted by the interlocking mechanism to the mechanism to be operated, and the mechanism to be operated operates.

In this way, in accordance with the lock device relating to the first aspect, if the operator inserts a key into the key insertion hole and pushes the key, the mechanism to be operated can be set in an operating state if the key is a proper key, and the mechanism to be operated can be maintained in a non-operating state if the key is an improper key. Accordingly, as compared with a rotary-type lock device in which operation (key operation) with respect to the mechanism to be operated is carried out by rotating the key after the key has been inserted in the key insertion hole, there is no need to transfer torque by the key at the time of the key operation by the operator, and only load along the axial direction is applied to the key. Therefore, the mechanical strength along the twisting direction which is required of the key can be made to be sufficiently small.

Further, if an improper key is inserted into the key insertion hole, even if the operator pushes the improper key which is inserted in the key insertion hole and moves it from the standby position to the operating position, the transfer of pushing force from the plunger member is cut-off by the interlocking mechanism, and the mechanism to be operated is maintained in the non-operating state. Accordingly, even if an improper key is inserted in the key insertion hole and the plunger member is pushed excessively via the improper key, excessive force is not applied to the structural parts of the device such as the plunger member, the sleeve member, the interlocking mechanism, and the like. Therefore, breakage of these structural parts can be effectively prevented.

A second aspect for achieving the above-described object relates to the lock device of the first aspect further including pressing force converting means for, when the plunger member becomes integral with a proper key and moves toward the operating position while the sleeve member remains as is at the standby position, converting a portion of operational force, which is transferred to the plunger member via the proper key, into urging force which urges the side lock member toward the tumbler members.

A third aspect for achieving the above-described object relates to the lock device of the first or second aspect wherein an outer peripheral anchor hole opens at an inner peripheral surface of the case member, and an accommodating hole is formed so as to pass-through the sleeve member in the direction orthogonal to the axial direction, the accommodating hole coinciding with the outer peripheral anchor hole when the sleeve member is at the standby position, the lock device further comprising: an anchor member slidably accommodated in the accommodating hole, and an outer peripheral side end portion of the anchor member is able to be inserted into and removed from the outer peripheral anchor hole, and an inner peripheral side end surface of the anchor member is made to abut an outer peripheral surface of the plunger member; and an urging member disposed within the outer peripheral anchor hole, and urging the anchor member toward inside of the sleeve member when the sleeve member is at the standby position, wherein, when a proper key is inserted in the key insertion hole and the plunger member starts to move from the standby position toward the operating position due to pressing force from the outer peripheral surface of the plunger member, the outer peripheral side end portion of the anchor member is inserted into the outer peripheral anchor hole against urging force from the urging member so that the anchor member restrains the sleeve member at the standby position.

DESCRIPTION OF THE PREFERRED EMBODIMENTS

1. First Embodiment

Figures 1A, 1B:
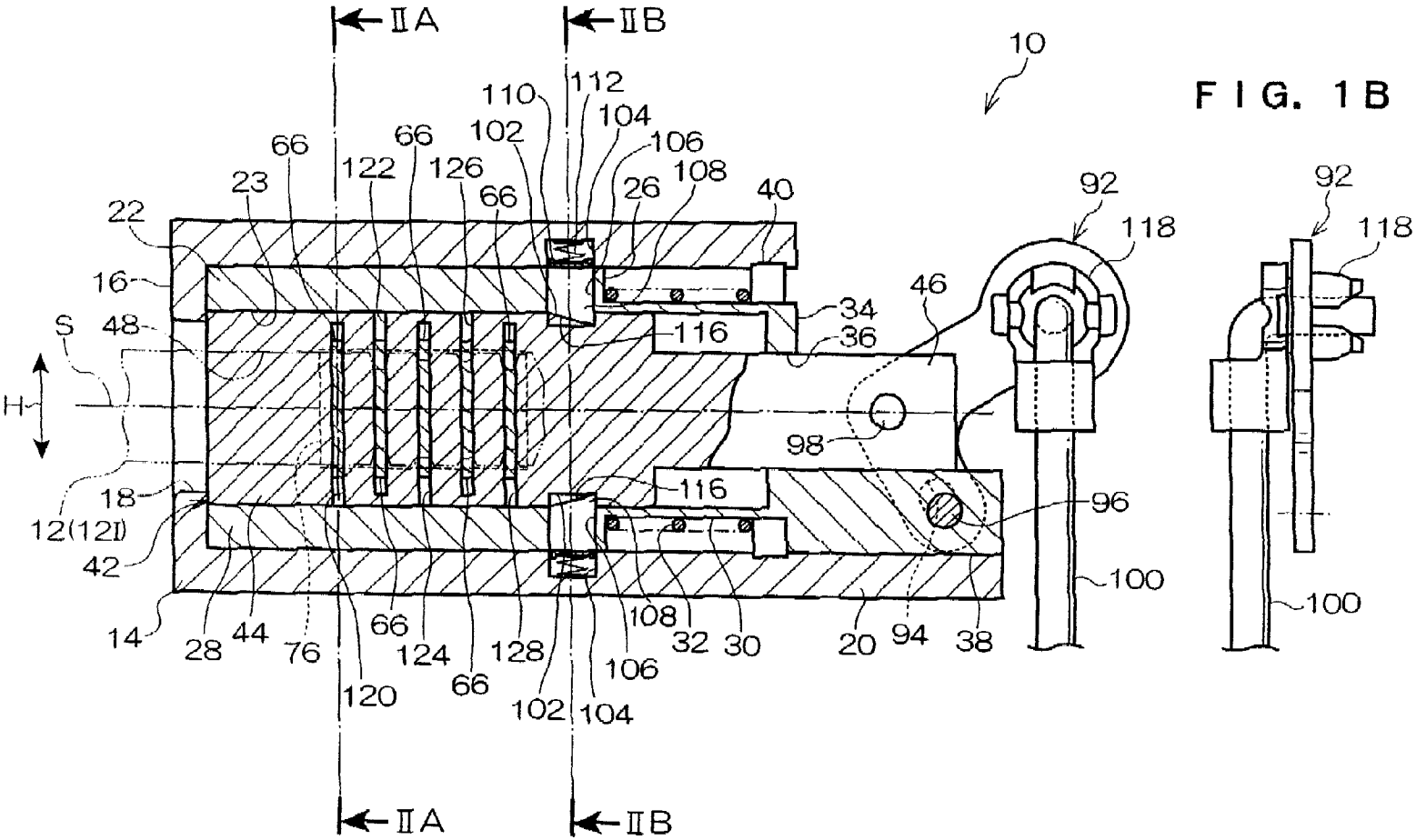
FIG. 1A is a cross-sectional view of a lock device relating to a first embodiment cut along a vertical plane which includes an axis thereof.
FIG. 1B is a front view, seen from a rear side in an axial direction, of an operation lever of the lock device.

A lock device relating to an embodiment of the present invention will be described hereinafter with reference to the drawings.

(Structure of the Lock Device)

In FIG. 1A through FIG. 5C, reference numeral S indicates an axial center of a device, and description will be given hereinafter with the direction along this axial center S being the axial direction of the device. A lock device 10 relating to the first embodiment is provided as a portion of a locking mechanism for setting an opening/closing member, such as a door of an automobile, a trunk hood, a door of a glove compartment, or the like in a locking state or in an unlocking state. The lock device 10 is used in order for an operator to operate the locking mechanism by a key 12 from a locking state to an unlocking state.

As shown in FIG. 1A, FIG. 1B, and FIG. 2A through FIG. 2C, a rectangular-cylindrical shaped case member 14 which serves as an outer shell portion of the device is provided in the lock device 10. The case member 14 is formed so as to be slender in the axial direction. The cross-sectional configuration of the peripheral wall portion of the case member 14 along the direction perpendicular to the axis is formed as a substantial rectangle whose longitudinal direction is the height-wise direction (the direction of arrow H). A cover portion 16 is formed at the case portion 14 so as to close the end portion at the axial direction distal end side (the left side in FIG. 1A). An opening portion 18, through which the key 12 can be inserted, is formed in the central portion of the cover portion 16. A plate-shaped lever guide 20, which extends along the axial direction, is formed integrally with the case member 14 at the lower end side of the rear end portion thereof.

The case member 14 is disposed at an accommodating body such as a door, a vehicle body, or the like which accommodates the locking mechanism. The case member 14 is fixed to the accommodating body such that the opening portion 18 faces toward the outer side of the accommodating body.

As shown in FIG. 1A, FIG. 1B, and FIG. 2A through FIG. 2C, the lock device 10 has a rectangular-cylindrical shaped sleeve member 22 which is disposed at the interior of the case member 14. The sleeve member 22 is formed so as to be slender in the axial direction. The cross-sectional configuration of the peripheral wall portion of the sleeve member 22 along the direction perpendicular to the axis is formed as a substantial rectangle whose longitudinal direction is the height-wise direction. The sleeve member 22 is inserted in the interior of the case member 14, and is supported by the case member 14 so as to be slidable along the axial direction.

Figures 3A, 3B:
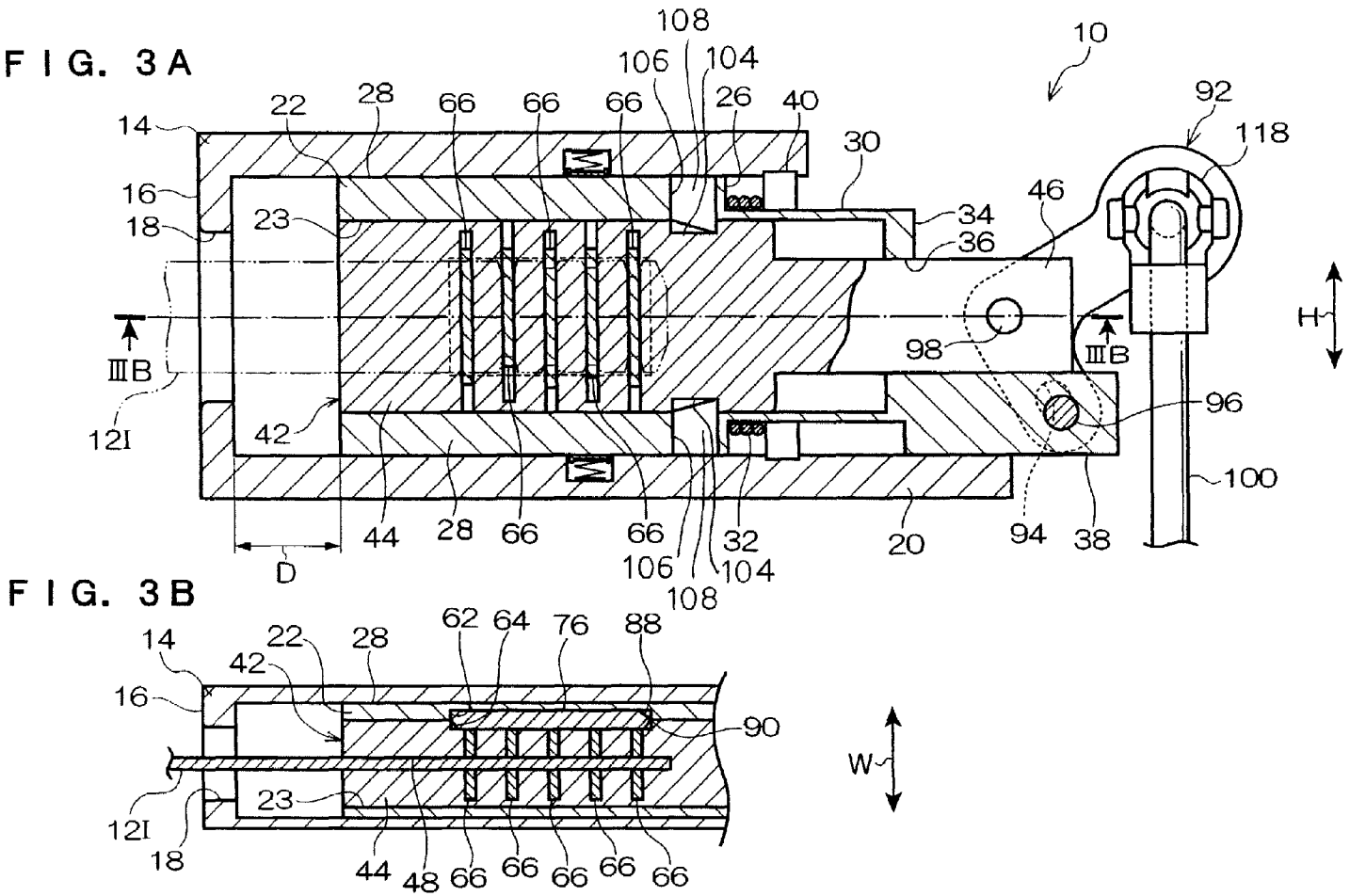
FIG. 3A is a cross-sectional view of the lock device cut along the vertical plane including the axis thereof, showing a state in which an improper key is inserted in a key insertion hole and a sleeve member and a plunger member have become integral and have moved to an operating position.
FIG. 3B is a cross-sectional view of the lock device cut along the cutting line IIIB-IIIB, showing the aforementioned state of the lock device.

The sleeve member 22 can slide along the axial direction between a standby position shown in FIG. 1 and an operating position shown in FIG. 3A and FIG. 3B. In the state in which the sleeve member 22 is at the standby position, the distal end surface of the sleeve member 22 abuts the inner side of the cover portion 16. When the sleeve member 22 slides from the standby position rearward by a predetermined operation stroke D (see FIG. 3A), the sleeve member 22 reaches the operating position. Further, the inner peripheral surface of the sleeve member 22 is a plunger-sliding surface 23 which a plunger member 42, which will be described later, slidably abuts.

A step portion 26 is formed at the sleeve member 22 at the axial direction intermediate portion of the outer peripheral surface thereof. A sleeve main body 28 is formed at the distal end side of this step portion 26, and a spring holding portion 30, whose outer diameter is smaller than that of the sleeve main body 28 is formed at the rear end side. The sleeve main body 28 is inserted and fit into the case member 14 so as to be slidable. A return spring 32 which has a coiled portion bent in a substantially rectangular shape, is fit on the outer peripheral side of the spring holding portion 30.

As shown in FIG. 1A, a cover portion 34 is formed at the sleeve member 22 so as to close the end portion thereof at the rear end side. A rod guiding hole 36, which passes-through in the axial direction and whose cross-section is rectangular, is formed in the central portion of the cover portion 34. Further, a slide lever 38, which extends from the lower end portion of the cover portion 34 toward the rear end side, is formed integrally with the sleeve member 22. The bottom end surface of the slide lever 38 slidably abuts the top end surface of the lever guide 20 at the case member 14.

A spring-supporting endplate 40 is disposed in the lock device 10 between the rear end portion at the inner peripheral surface of the case member 14, and the outer peripheral surface of the spring holding portion 30. The outer peripheral surface of the spring-supporting endplate 40 is fixed to the inner peripheral surface of the case member 14, and the inner peripheral surface of the spring-supporting endplate 40 abuts the outer peripheral surface of the spring holding portion 30 so as to be slidable. In the lock device 10, the return spring 32 is interposed between the step portion 26 of the sleeve member 22 and the spring-supporting endplate 40, and is in a compressed state. In this way, the return spring 32 always urges the sleeve member 22 toward the standby position (refer to FIG. 1A).

As shown in FIG. 1A, FIG. 1B, and FIG. 2A through FIG. 2C, the lock device 10 has the plunger member 42 which is disposed at the interior of the sleeve member 22. The plunger member 42 is formed in the shape of a substantially rectangular column which is slender in the axial direction. A plunger main body 44, which is inserted in the sleeve member 22, is provided at the axial direction distal end side of the plunger member 42. A plunger rod 46, which projects out from the central portion of the rear end surface of the plunger main body 44, is formed integrally at the plunger member 42. The plunger main body 44 is slidably inserted in the sleeve member 22. The outer peripheral surface of the plunger main body 44 is a sliding surface 47 which slidably contacts the plunger-sliding surface 23 of the sleeve member 22. Further, the plunger member 42 is supported by the case member 14 via the sleeve member 22 and configured to move between the standby position (see FIG. 1A) and the operating position (see FIG. 3A and FIG. 4A).

In the state in which the plunger member 42 is at the standby position, the distal end surface thereof abuts the inner side of the cover portion 16. When the plunger member 42 moves rearward by the predetermined operation stroke D (see FIG. 3A and FIG. 4A) from the standby position, the plunger member 42 reaches the operating position. In the lock device 10, as described previously, the sleeve member 22 is also supported by the case member 14 and configured to move between the standby position and the operating position.

Figure 2A:
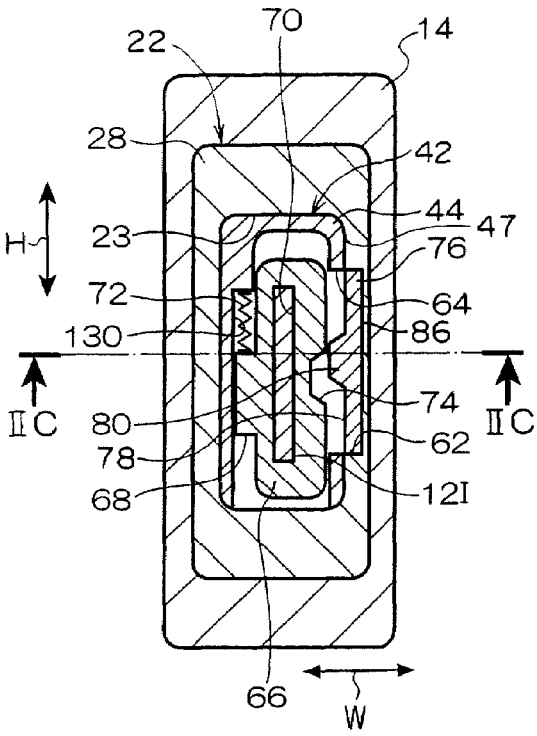
FIG. 2A is a cross-sectional view of the lock device shown in FIG. 1A cut along the cutting line IIA-IIA.

As shown in FIG. 1A, the plunger member 42 passes through the rod guiding hole 36, and the rear end side of the plunger rod 46 projects-out toward the outer side of the sleeve member 22. The bottom end surface of the portion of the plunger rod 46 which projects-out from the rod guiding hole 36 slidably abuts the top end surface of the slide lever 38. Further, as shown in FIG. 1A, FIG. 2A and FIG. 2C, a key insertion hole 48, which extends along the axial direction, is formed in the central portion of the plunger main body 44. The key insertion hole 48 extends from the distal end surface of the plunger main body 44 to the rear end side thereof. The cross-sectional shape of the key insertion hole 48 is the shape of a slit which is slender along the height-wise direction of the device. The cross-sectional shape of the key insertion hole 48 corresponds to the shape of the key 12 (see FIG. 6) which corresponds to the standards of the lock device 10 relating to the present embodiment. The key 12 can be inserted into and removed from the key insertion hole 48.

Figure 4A:
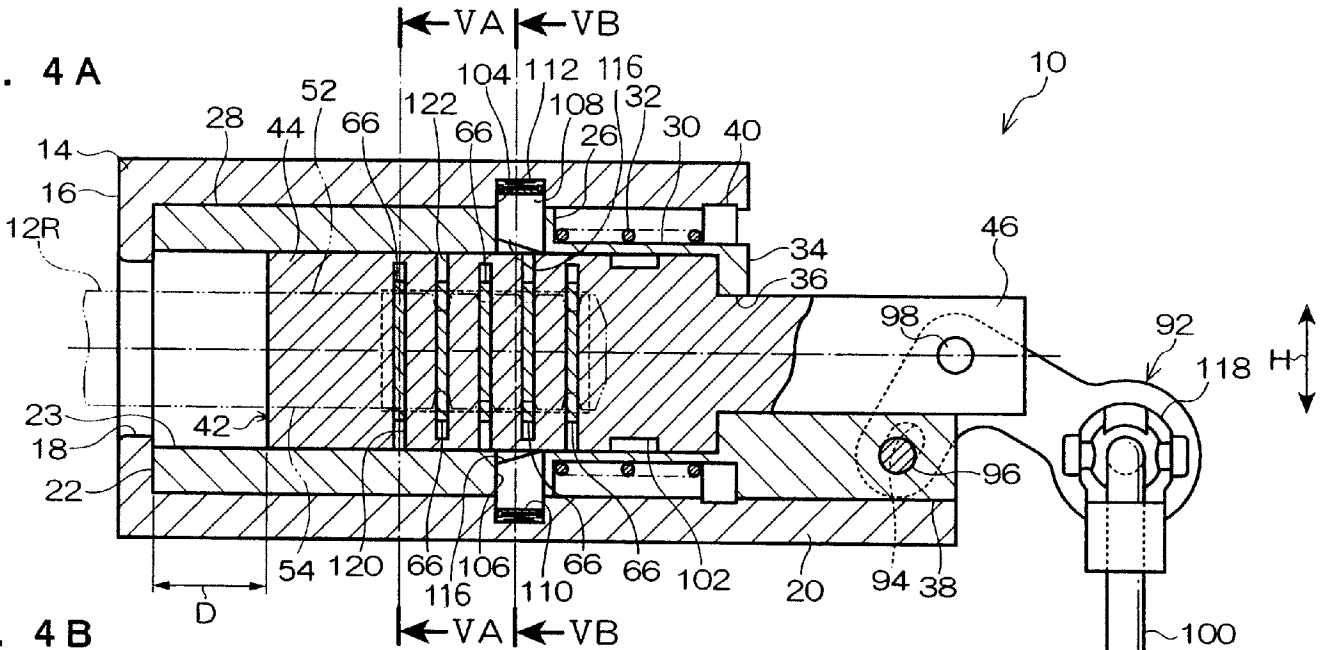
FIG. 4A is a cross-sectional view of the lock device cut along the vertical plane including the axis thereof, showing a state in which a proper key is inserted in the key insertion hole and the plunger member has moved to the operating position.
Figure 4B:
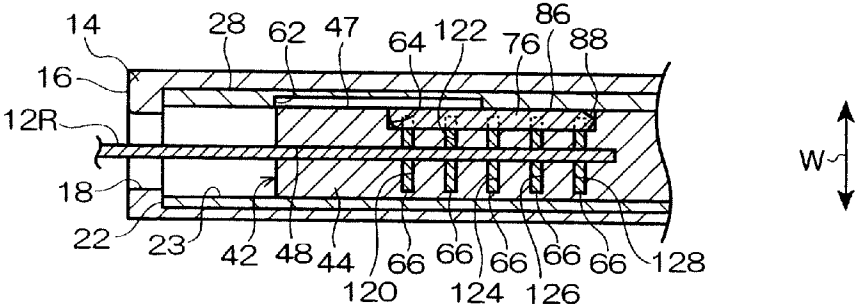
FIG. 4B is a cross-sectional view of the lock device cut along the cutting line IVB-IVB showing the aforementioned state of the lock device.
Figure 5A:
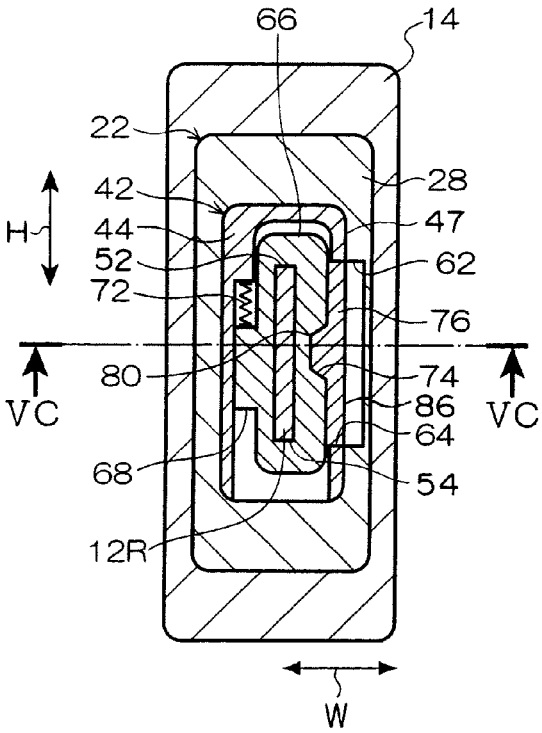
FIG. 5A is a cross-sectional view of the lock device shown in FIG. 4A and FIG. 4B cut along the cutting line VA-VA.
Figure 5B:
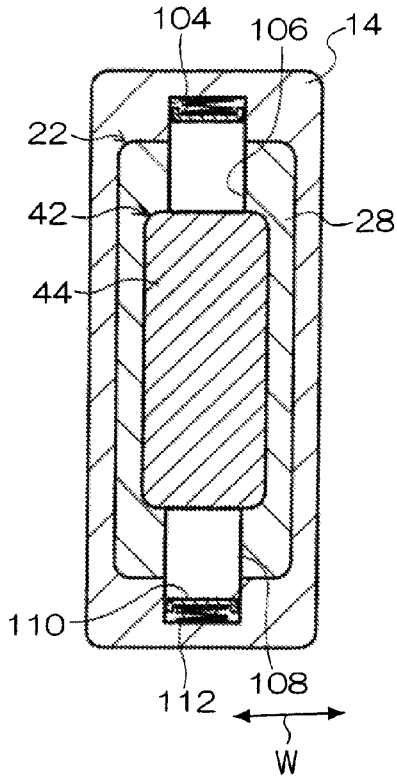
FIG. 5B is a cross-sectional view of the lock device along the cutting line VB-VB.

As shown in FIG. 3A, FIG. 3B, FIG. 4A, FIG. 4B, and FIG. 6, the portion of the key 12 which is inserted in the key insertion hole 48 is formed in the shape of a slender plate, and is manufactured of a material such as a metal, a resin, a paper, a composite material thereof, or the like. An insertion guide portion 50, whose thickness becomes thinner in the shape of a slope from the proximal end side toward the distal end side, is formed at the distal end portion of the key 12. Each edge surface of the key 12 along the longitudinal direction thereof are an upper engaging edge 52 and a lower engaging edge 54, respectively. As shown in FIG. 4A, FIG. 4B, and FIG. 5A, the key 12 is inserted by the operator into the key insertion hole 48 while set at a posture such that the upper engaging edge 52 is directed toward the upper side along the height-wise direction of the device.

Figure 6:
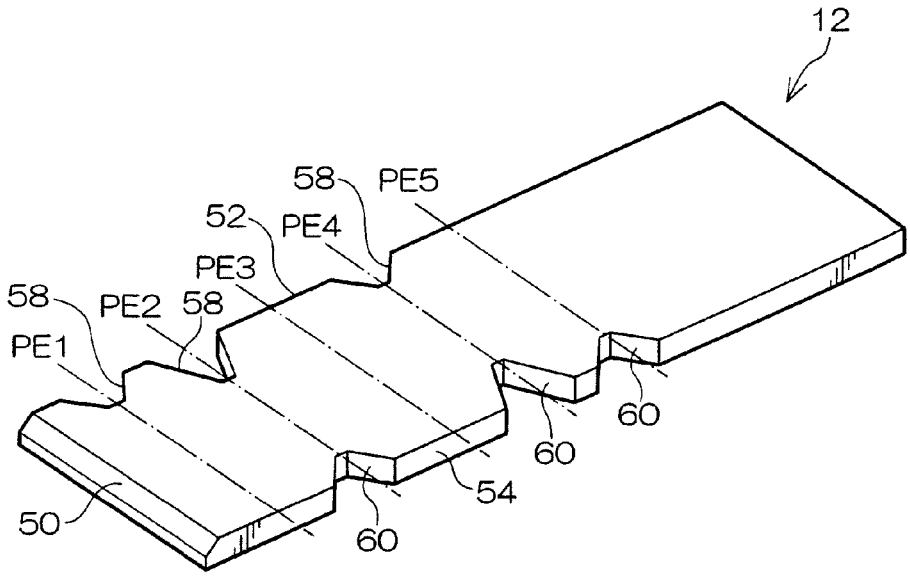
FIG. 6 is a perspective view showing an example of a key used in the lock device shown in FIG. 1A and FIG. 1B.

As shown in FIG. 6, five engaging notches PE1 through PE5 which are respectively different in the position and the shape thereof are set along the longitudinal direction of the key 12 (the axial direction of the device) at the upper engaging edge 52 and the lower engaging edge 54 of the key 12. Respectively and selectively at the engaging notches PE1 through PE5, engaging portions 58 which are hollowed-out in V-shapes are formed, or planar engaging portions 60 are provided by not carrying out shape machining on the upper engaging edge 52 and the lower engaging edge 54.

As shown in FIG. 2A and FIG. 2C, a concave latch opening 62 is formed on the plunger-sliding surface 23 at the sleeve member 22. The latch opening 62 is formed in the side surface portion at one end side (the right side in FIG. 2A) in the transverse direction (the direction of arrow W) at the plunger-sliding surface 23. The inner peripheral side of the latch opening 62 opens to face the sliding surface 47 of the plunger member 42, and the outer peripheral side thereof is closed-off. The cross-sectional configuration of the latch opening 62 along the height-wise direction of the device is formed in a substantially rectangular shape whose longitudinal direction is the axial direction of the device.

As shown in FIG. 1A and FIG. 2C, plural (five in the present embodiment) tumbler accommodating chambers 120 through 128 are formed in slit-shapes in the plunger main body 44. These tumbler accommodating chambers 120 through 128 are arranged at a substantially uniform pitch along the axial direction, and this pitch is substantially the same as the pitch of the five engaging notches PE1 through PE5 at the key 12.

Each of the tumbler accommodating chambers 120 through 128 extends so as to be slender along the height-wise direction of the device. At the tumbler accommodating chambers 120, 124, 128, which are disposed at the odd-numbered positions from the distal end side of the plunger main body 44, the bottom end sides are open to the bottom end surface of the plunger main body 44, and the top end sides thereof are closed-off. At the tumbler accommodating chambers 122, 126 which are disposed at the even-numbered positions, the top end sides thereof are open to the top end surface of the plunger main body 44, and the bottom end sides thereof are closed-off. Further, a guide slot 130, which is concave toward the outer peripheral side, is formed integrally in the side surface portion of the transverse direction other end side (the left side in FIG. 2A) of each of the tumbler accommodating chambers 120 through 128. The guide slots 130 extend from the open ends to the intermediate portions along the directions of thickness of the tumbler accommodating chambers 120 through 128. In this way, the widths at the entrance sides at the tumbler accommodating chambers 120 through 128 are wider, by the widths of the guide slots 130, than the widths at the deeper sides thereof.

As shown in FIG. 2A and FIG. 2C, a concave holder opening 64 is formed in the plunger main body 44 in the side end surface of the transverse direction other end side of the device (the left side in FIG. 2A). The holder opening 64 opens at the sliding surface 47 of the plunger main body 44, with the transverse direction outer side of the holder opening 64 being the open end thereof. The transverse direction inner side end portion of the holder opening 64 overlaps the tumbler accommodating chambers 120 through 128 and the side end portions. Further, the cross-sectional configuration (the opening configuration) of the holder opening 64 along the height-wise direction of the device is the same as the opening configuration of the latch opening 62 of the sleeve member 22. When the sleeve member 22 and the plunger member 42 are at the same position along the axial direction, the holder opening 64 coincides with the latch opening 62, and the holder opening 64 and the latch opening 62 communicate with one another.

As shown in FIG. 1A, FIG. 2A and FIG. 2C, a tumbler plate 66 is disposed so as to be slidable along the height-wise direction of the device, within each of the tumbler accommodating chambers 120 through 128 at the plunger main body 44. The tumbler plate 66 is formed in a substantially rectangular shape whose longitudinal direction is the height-wise direction. The thickness of the tumbler plate 66 is slightly smaller than the widths of the tumbler accommodating chambers 120 through 128 along the axial direction. A rectangular seat-receiving piece 68, which projects-out toward the outer side, is formed integrally with the tumbler plate 66 at the side end portion at the other end side along the transverse direction of the device. An engaging concave portion 74, which is sunk in toward the inner side in a substantially trapezoidal shape, is formed in the side end surface at the one end side. Further, an insert opening 70, which passes along the direction of thickness through the central portions of the obverse and reverse surfaces, is formed in the tumbler plate 66. The insert opening 70 is formed in the shape of a slit which is slender along the height-wise direction of the device. The opening width of the insert opening 70 along the height-wise direction is slightly wider than a width B (see FIG. 6) of the key 12.

A coil spring 72 is disposed in the guide slot 130 of each of the tumbler accommodating chambers 120 through 128. The coil spring 72 is nipped between the seat-receiving piece 68 of the tumbler plate 66 and the floor surface of the guide slot 130 so as to always be in a compressed state. In this way, the tumbler plates 66, which are disposed within the respective tumbler accommodating chambers 120 through 128, are always urged by the coil springs 72 toward the opening end sides of the tumbler accommodating chambers 120 through 128. Specifically, the tumbler plates 66 within the tumbler accommodating chambers 120, 124, 128 are always urged downward, and the tumbler plates 66 within the tumbler accommodating chambers 122, 126 are always urged upward.

At the plunger member 42, before the key 12 is inserted in the key insertion hole 48, the key insertion hole 48 overlaps the top end sides of the insert openings 70 at the three tumbler plates 66 which are urged downward and overlaps the bottom end sides of the insert openings 70 of the two tumbler plates 66 which are urged upward, along the height-wise direction of the device. In the lock device 10, when the key 12 is inserted into the key insertion hole 48 of the plunger member 42 which is at the standby position, the key 12 is inserted through the insert openings 70 of the respective tumbler plates 66, and the top side edge portion or the bottom side edge portion of the insert opening 70 at each of the tumbler plates 66 press-contacts the upper engaging edge 52 or the lower engaging edge 54 at the key 12, and engages with the engaging portions 58, 60. Specifically, the tumbler plates 66 within the tumbler accommodating chambers 120, 124, 128 engage with the engaging portions 58 formed at the engaging notches PE1, PE3 and PE5 at the upper engaging edge 52, and the tumbler plates 66 within the tumbler accommodating chambers 122, 126 engage with the engaging portions 60 formed at the engaging notches PE2 and PE4 at the lower engaging edge 54.

Accordingly, in the lock device 10, when the key 12 is inserted into the key insertion hole 48, the five tumbler plates 66 respectively slide along the height-wise direction of the device (the sliding direction) to positions corresponding to the engaging portions 58, 60 which are their engagement partners at the key 12. Here, a key code for unlocking is given in advance to the lock device 10, and the configurations (depths) of the engaging portions 58, 60, which are the engagement partners of the tumbler plates 66, are respectively determined in accordance with the key code.

If the key 12 conforms to the standards of the lock device 10 relating to the present embodiment, the key 12 can be inserted into and removed from the key insertion hole 48. As the key 12, there exist a key in which the shapes of all of the engaging portions 58, 60 which are the engagement partners of the tumbler plates 66 correspond to the key code (hereinafter, such a key will be called a "proper key 12R"), and a key in which the shape of at least one of the engaging portions 58, 60 which are the engagement partners of the tumbler plates 66 does not correspond to the key code. Note that the keys 12 whose shapes do not coincide with the proper key 12R, and key substitutes such as a screwdriver and the like which can be inserted into the key insertion hole 48 in place of the key 12, are collectively called "improper keys 12I".

In the lock device 10, when the proper key 12R is inserted into the key insertion hole 48, as shown in FIG. 4A, the five tumbler plates 66 move to the positions corresponding to the engaging portions 58, 60. At this time, as shown in FIG. 5A, the engaging concave portions 74 of the respective tumbler plates 66 move to positions at which the centers thereof along the height-wise direction substantially coincide with the axial center S of the device (hereinafter, these positions will be called "proper positions"), and are maintained at these proper positions. Here, if the tumbler plate 66 is at a position other than the proper position along the height-wise direction, that tumbler plate 66 is at an improper position.

In the lock device 10, when the improper key 12I is inserted into the key insertion hole 48, as shown in FIG. 3A, some of the tumbler plates 66 engage with the engaging portions 58, 60 and move to corresponding positions, whereas the remaining tumbler plates 66 are maintained at their initial positions without engaging with the engaging portions 58, 60. In this way, at least one tumbler plate 66 definitely moves along the height-wise direction to an improper position which does not coincide with the axial center S, or is held at the initial position without moving from the initial position (=an improper position).

Figure 7:
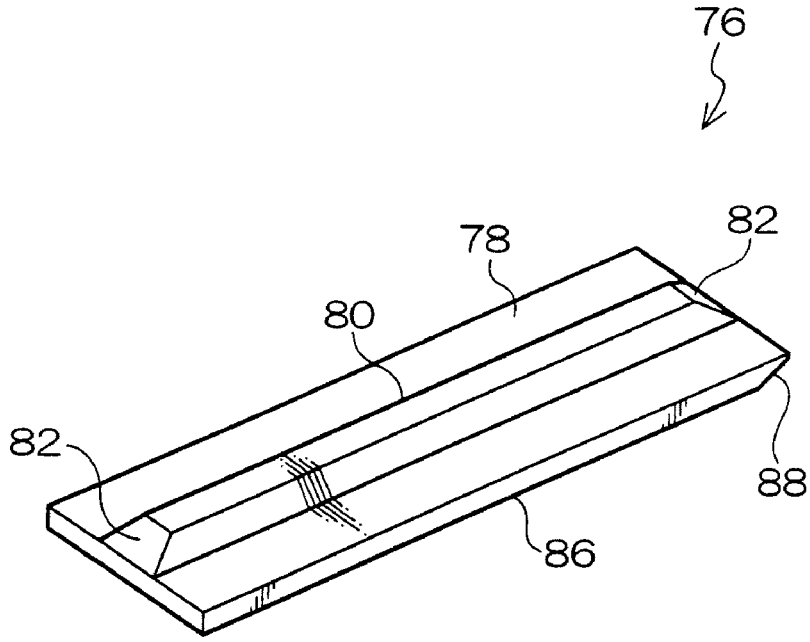
FIG. 7 is a perspective view showing the structure of a side lock plate in the lock device shown in FIG. 1A and FIG. 1B.

As shown in FIG. 2A and FIG. 2C, a side lock plate 76 is disposed within the holder opening 64 at the plunger member 42, so as to be slidable along the transverse direction of the device. The side lock plate 76 is formed in the shape of a substantially rectangular plate whose longitudinal direction is the axial direction. As shown in FIG. 7, a projecting portion 80 which extends in the axial direction is formed integrally with the side lock plate 76 at an abutting surface 78 which is the surface at the inner side in the transverse direction of the device. The cross-sectional configuration of the projecting portion 80 along the axial direction is substantially trapezoidal, and the projecting portion 80 can be inserted in and removed from the engaging concave portions 74 at the tumbler plates 66.

As shown in FIG. 2A and FIG. 7, the projecting portion 80 is disposed at the central portion of the abutting surface 78 along the height-wise direction of the device. In the state in which the side lock plate 76 is held within the holder opening 64, the center of the projecting portion 80 along the height-wise direction is positioned at substantially the same position as the axial center S. Guide surfaces 82, which are inclined toward the inner side in the longitudinal direction of the side lock plate 76, are formed at the respective longitudinal direction end portions of the projecting portion 80. Further, a cam surface 88 is formed at the end portion at the distal end side along the axial direction, at an insertion surface 86 which is at the opposite side of the abutting surface 78 of the side lock plate 76. As shown in FIG. 2C, the cam surface 88 is inclined at a slope toward the axial center S from the rear end thereof toward the distal end side thereof.

In the lock device 10, when the proper key 12R is inserted in the key insertion hole 48 and all of the tumbler plates 66 move to the proper positions due to the proper key 12R, the projecting portion 80 of the side lock plate 76 which is disposed within the holder opening 64 coincides with the engaging concave portions 74 of the tumbler plates 66, and can advance into the engaging concave portions 74 (see FIG. 4B and FIG. 5A). Further, In the lock device 10, when the improper key 12I is inserted in the key insertion hole 48 and at least one of the tumbler plates 66 is held at an improper position by the improper key 12I, the projecting portion 80 of the side lock plate 76 does not coincide with the engaging concave portion 74 of the tumbler plate 66 which is at an improper position, and the distal end portion of the projecting portion 80 abuts the side end portion of the tumbler plate 66 which is at an improper position. Therefore, the projecting portion 80 cannot advance into any of the engaging concave portions 74 (refer to FIG. 2A and FIG. 3B).

As shown in FIG. 2A and FIG. 2C, in the lock device 10, when the projecting portion 80 of the side lock plate 76 cannot advance into the engaging concave portions 74 of the tumbler plates 66, a portion of the insertion surface 86 side of the side lock plate 76 projects-out toward the outer side along the transverse direction from within the holder opening 64, and is held at a position (locking position) of being inserted within the latch opening 62 of the sleeve member 22. In this way, the side lock plate 76 connects the plunger member 42 and the sleeve member 2) to one another along the axial direction, and the plunger member 42 and the sleeve member 22 always become integral and move between the standby position and the operating position.

Figure 5C:
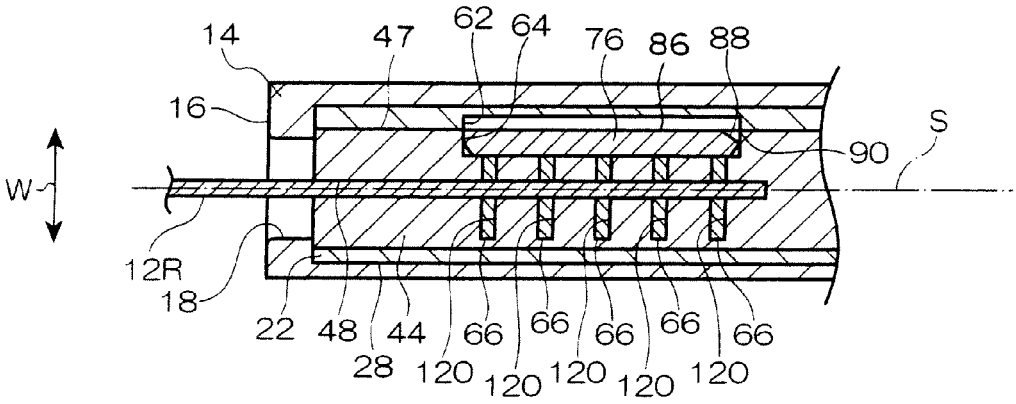
FIG. 5C is a cross-sectional view of the lock device along the cutting line VC-VC.

On the other hand, as shown in FIG. 4B, FIG. 5A and FIG. 5C, when the projecting portion 80 of the side lock plate 76 is set in the state of having advanced-in completely into the engaging concave portions 74 of the tumbler plates 66, a portion of the insertion surface 86 side of the side lock plate 76 moves away from the interior of the latch opening 62, and the insertion surface 86 moves along the transverse direction to a position (unlocking position) which is slightly more toward the inner side than the sliding surface 47 of the plunger member 42. In this way, the side lock plate 76 cancels the connection of the plunger member 42 and the sleeve member 22, and the plunger member 42 can move singly between the standby position and the operating position, while the sleeve member 22 remains as is at the standby position.

When the proper key 12R is inserted in the key insertion hole 48 and the plunger member 42 is pushed via the proper key 12R toward the operating position, because the sleeve member 22 is always urged toward the standby position by the return spring 32, the plunger member 42 starts to move from the standby position toward the operating position, while the sleeve member 22 remains as is at the standby position.

At this time, an entrance side edge portion 90 (see FIG. 2C) of the latch opening 62 pushes the cam surface 88 of the side lock plate 76 along the axial direction toward the operating position. The cam surface 88 converts a portion of the pushing force from the edge portion 90 into urging force directed toward the tumbler plates 66. In this way, even if the side lock plate 76 is at the locking position at the time when the proper key 12R is inserted in the key insertion hole 48 and the plunger member 42 starts to move toward the operating position, the side lock plate 76 reliably moves from the locking position to the unlocking position simultaneously with the start of movement of the plunger member 42.

As shown in FIG. 1A and FIG. 1B, the lock device 10 has an operation lever 92 which is connected to the distal end portion of the slide lever 38 and is connected to the distal end portion of the plunger rod 46. The operation lever 92 is formed in the shape of a slender plate, and is bent in a substantial V-shape along the longitudinal direction. A connection hole 94, which is elliptical and is slender in the longitudinal direction of the lever, is formed in the proximal end portion (the lower end portion in FIG. 1A and FIG. 1B) of the operation lever 92. Further, a connecting shaft 96, which is shaped as a cylindrical column and whose axial direction is the transverse direction of the device, is provided at the distal end portion of the slide lever 38. The connecting shaft 96 is inserted in the connection hole 94 of the operation lever 92 so as to be able to rotate relatively, and can move within the connection hole 94 along the longitudinal direction of the connection hole 94. In this way, the proximal end portion of the operation lever 92 is swingably connected to the distal end portion of the slide lever 38 via the connecting shaft 96.

A pushing shaft 98, which is shaped as a cylindrical column and whose axial direction is the transverse direction of the device, is provided at the distal end portion of the plunger rod 46. The pushing shaft 98 passes-through a vicinity of the center along the longitudinal direction of the operation lever 92, and is connected to the operation lever 92 so as to be able to rotate relatively. Further, the distal end side of the operation lever 92 extends rearward along the axial direction from the distal end portion of the plunger rod 46. A cylindrical-cylindrical shaped shaft-receiving member 118 is mounted to the distal end portion of the operation lever 92. The top end portion of a connecting rod 100, which is shaped as a slender, round bar, is connected via the shaft-receiving member 118 to the distal end portion of the operation lever 92 so as to be able to rotate relatively. The connecting rod 100 extends along the height-wise direction of the device, and the bottom end portion thereof is connected to the main body portion (not shown) of a locking mechanism. The operation lever 92 can swing between a predetermined locking position (see FIG. 1A) and unlocking position (see FIG. 4A) around the connecting shaft 96 of the slide lever 38.

In the lock device 10, as shown in FIG. 1A, the positions of the connecting shaft 96 and the pushing shaft 98 along the axial direction are respectively set such that, when the sleeve member 22 and the plunger member 42 are at the standby position, the operation lever 92 is held at the locking position.

Further, as shown in FIG. 4A and FIG. 4B, when only the plunger member 42 moves from the standby position to the operating position in the state in which the sleeve member 22 is at the standby position, the pushing shaft 98 moves rearward along the axial direction with respect to the connecting shaft 96, and pushing force along the axial direction is applied to the operation lever 92 from the plunger member 42 via the pushing shaft 98. In this way, the operation lever 92 swings from the locking position toward the unlocking position around the connecting shaft 96, and, when the plunger member 42 reaches the operating position, the operation lever 92 is swung to the unlocking position.

When the operation lever 92 swings from the locking position toward the unlocking position, the operation lever 92 transmits pushing force (operating force) along the height-wise direction of the device to the main body portion of the locking mechanism via the connecting rod 100, while moving the connecting rod 100 downward. The state of the main body portion of the locking mechanism, which receives this operating force, changes from a locking state to an unlocking state, and the opening/closing member, such as the door, the trunk hood, the glove compartment door, or the like which was locked by the locking mechanism, becomes able to open.

Further, when the opening/closing member which has been opened is to be closed again, the main body portion of the locking mechanism transfers pushing force (return force) to the operation lever 92 via the connecting rod 100, and urges the operation lever 92, which is at the unlocking position, toward the locking position. Due to this urging force from the main body portion of the locking mechanism, the operation lever 92 which is at the unlocking position returns to the locking position, and the plunger member 42 which is at the operating position returns to the standby position.

As shown in FIG. 3, in the lock device 10, when the sleeve member 22 and the plunger member 42 become integral and move from the standby position to the operating position the operation lever 92 is held at the locking position because the relative positional relationship between the pushing shaft 98 and the connecting shaft 96 along the axial direction does not change. Accordingly, even if the sleeve member 22 and the plunger member 42 become integral and move from the standby position to the operating position, the main body portion of the locking mechanism is maintained in the locking state and is not set in an unlocking state. In this state, when the operator stops pushing toward the key 12 (in this case, a key whose configuration is different than the proper key 12R), the sleeve member 22 and the plunger member 42 which are at the operating position return to the standby position due to the return force of the return spring 32.

As shown in FIG. 1, in the lock device 10, an inner peripheral anchor hole 102 which is concave is formed in each of the top end portion and the bottom end portion of the outer peripheral surface of the plunger main body 44. An outer peripheral anchor hole 104 which is concave is formed in each of the top end portion and the bottom end portion of the inner peripheral surface of the case member 14. The inner peripheral anchor holes 102 are disposed at the rear end side of the tumbler plates 66 at the plunger main body 44 along the axial direction. When the plunger member 42 is at the standby position, the outer peripheral anchor holes 104 are positioned at the same positions as the inner peripheral anchor holes 102 along the axial direction and the transverse direction of the device.

Accommodating holes 106, which pass-through along the direction perpendicular to the axis, are formed in the sleeve member 22 in the lock device 10. When the sleeve member 22 and the plunger member 42 are at the standby position, the accommodating holes 106 are positioned at the same positions as the outer peripheral anchor holes 104 and the inner peripheral anchor holes 102 along the axial direction and the transverse direction. The cross-sectional configurations of the outer peripheral anchor holes 104, the inner peripheral anchor holes 102, and the accommodating holes 106 along the axial direction coincide with one another.

Figure 2B:
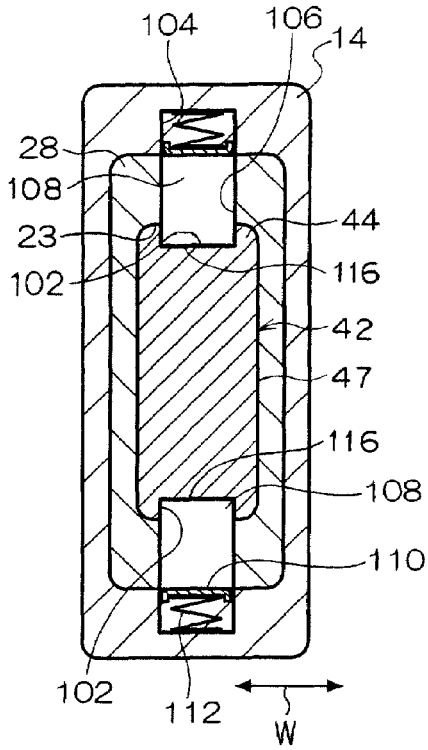
FIG. 2B is a cross-sectional view of the lock device cut along the cutting line IIB.
Figure 2C:
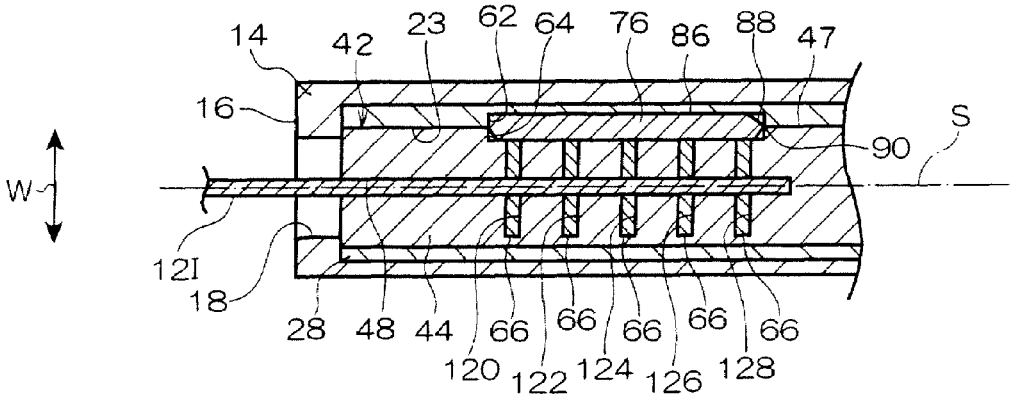
FIG. 2C is a cross-sectional view of the lock device cut along the cutting line IIC-IIC.

As shown in FIG. 1A and FIG. 2B, in the lock device 10, anchor bars 108, which are shaped as substantially rectangular columns, are accommodated in the accommodating holes 106 so as to be slidable along the direction perpendicular to the axis, and urging plates 110 and springs 112 are inserted in the outer peripheral anchor holes 104. The end surfaces at the outer peripheral sides of the anchor bars 108 (rear end surfaces) are flat surfaces which are parallel to the axial direction. The distal end surfaces of the anchor bars 108 are cam surfaces 116 which are shaped as flat plates which are inclined toward the outer peripheral side from the rear ends toward the distal ends along the axial direction.

When the sleeve member 22 is at the standby position, in the state in which the rear end surfaces of the anchor bars 108 press-contact the plate-shaped urging plates 110, the rear end portions of the anchor bars 108 can be inserted into and removed from the outer peripheral anchor holes 104. When the sleeve member 22 and the plunger member 42 are at the same position along the axial direction, the distal end portions of the anchor bars 108 are inserted in the inner peripheral anchor holes 102 so as to be able to be inserted into and removed therefrom, and press-contact the floor surface portions of the inner peripheral anchor holes 102. The urging plates 110 are slidably inserted in the outer peripheral anchor holes 104. The springs 112 are disposed in compressed states between the urging plates 110 and the floor surface portions of the outer peripheral anchor holes 104.

In the lock device 10, when the proper key 12R is inserted in the key insertion hole 48 and the plunger member 42 starts to move from the standby position to the operating position, due to the cam surfaces 116 of the anchor bars 108 receiving a component of force (pushing force) along the direction perpendicular to the axis from the outer peripheral surface of the plunger member 42, the anchor bars 108 are pushed-out toward the outer peripheral side against the urging forces of the springs 112. In this way, as shown in FIG. 4A, the rear end portions of the anchor bars 108 are inserted in the outer peripheral anchor holes 104. At this time, because the anchor bars 108 are at positions which straddle the borders between the outer peripheral anchor holes 104 and the accommodating holes 106, the sleeve member 22 is restrained at the standby position. When the plunger member 42, which had moved toward the operating position, returns to the standby position, the anchor bars 108 move toward the inner side due to the urging forces of the springs 112 and the distal end portions of the anchor bars 108 are inserted in the inner peripheral anchor holes 102.

On the other hand, when an improper key 12I whose shape is different than that of the proper key 12R is inserted into the key insertion hole 48 and the plunger member 42 is connected to the sleeve member 22 by the side lock plate 76, the anchor bars 108 are held within the accommodating holes 106 and the inner peripheral anchor holes 102, and the sleeve member 22 and the plunger member 42 become integral and move along the axial direction.

(Operation of Lock Device)

Operation of the lock device 10 relating to the present embodiment will be described in the following.

In the lock device 10, when the proper key 12R is inserted into the key insertion hole 48 by the operator and the plunger member 42 is pushed toward the operating position via the proper key 12R, only the plunger member 42 starts to move from the standby position toward the operating position, while the sleeve member 22 is restrained at the standby position by the anchor bars 108. Interlockingly with this movement of the plunger member 42 toward the operating position, the operation lever 92, which has been at the locking position, swings toward the unlocking position. When the plunger member 42 reaches the operating position, the operation lever 92 swings to the unlocking position, and the main body portion of the locking mechanism, which has been in the locking state, is set in the unlocking state. In this way, the opening/closing member, which has been locked by the locking mechanism, is unlocked, and becomes able to open. Thereafter, when the opened opening/closing member is closed again, due to return force being transmitted to the operation lever 92 from the main body portion of the locking mechanism via the connecting rod 100, the operation lever 92 which has been at the unlocking position returns to the locking position, and the plunger member 42 which has been at the operating position returns to the standby position.

Further, in the lock device 10, when the improper key 12I, such as the key 12 whose shape is different than the proper key 12R or a key substitute or the like, is inserted into the key insertion hole 48 by the operator, the sleeve member 22 and the plunger member 42 are connected by the side lock plate 76. In this way, when the plunger member 42 is pushed toward the operating position via the improper key 12I, the plunger member 42 and the sleeve member 22 become integral and start to move from the standby position toward the operating position. In the lock device 10, even if the plunger member 42 and the sleeve member 22 reach the operating position after having become integral, the operation lever 92 which is at the locking position does not swing, and therefore, the main body portion of the locking mechanism is maintained in the locking state as it has been. Thereafter, when the operator stops pushing toward the improper key 12I, due to the restoring force of the return spring 32, the plunger member 42 and the sleeve member 22 become integral and return to the standby position.

Accordingly, in the lock device 10 relating to the present embodiment, when an operator inserts the key 12 into the key insertion hole 48 and pushes the key 12 along the axial direction of the device, if the key 12 is the proper key 12R, the main body portion of the locking mechanism is set in an unlocking state, on the other hand, if the key 12 is the improper key 12I, the main body portion of the locking mechanism can be maintained in the locking state. Therefore, comparing with a rotary-type lock device in which operation of the mechanism to be operated is carried out by rotating the key after inserting the key into the key insertion hole, there is no need for torque transmission by the key 12 at the time of key operation by the operator, and only load along the axial direction is basically applied to the key 12. Therefore, the mechanical strength along the twisting direction, which is required of the key 12, can be made to be sufficiently small.

As a result, in accordance with the lock device 10 relating to the present embodiment, it is not absolutely necessary to manufacture the key 12 from a material with high mechanical strength, such as iron, stainless steel, or the like. The key 12 can be manufactured of a material, which has a low strength and is regarded to be difficult to be used as a material for a key, such as, for example, plastic, water proof-treated paper, aluminum alloys, magnesium alloys, and the like. Further, as compared with conventional keys, even if the thickness of the key 12 is made to be much thinner, problems such as deformation and the like do not arise.

In the lock device 10, even if an improper key 12I such as a screwdriver or the like is inserted in the key insertion hole 48 and this improper key 12I is pushed toward the operating position, the plunger member 42 and the sleeve member 22 merely become integral and move from the standby position to the operating position, and the main body portion of the locking mechanism is not set in the unlocking state, and further, excessive force is not applied to the structural parts of the device such as the case member 14, the sleeve member 22 and the plunger member 42, and the tumbler plates 66, the side lock plate 76 and the like which are disposed thereat. Therefore, breakage of these structural parts can be effectively prevented.

Further, in the lock device 10, when the key 12 is inserted into the key insertion hole 48, the plural tumbler plates 66 respectively engage with the engaging portions 58, 60 which are provided at the upper engaging edge 52 and the lower engaging edge 54 of the key 12, and move along the direction perpendicular to the axis to positions corresponding to the engaging portions 58, 60.

In the case when the proper key 12R is inserted in the key insertion hole 48 and all of the tumbler plates 66 move to the proper positions corresponding to the proper engaging portions 58, 60, the side lock plate 76 engages with the engaging concave portions 74 at the tumbler plates 66, and cancels the connected state of the sleeve member 22 and the plunger member 42.

On the other hand, in the case when the improper key 12I is inserted in the key insertion hole 48 and at least one of the tumbler plates 66 does not move to the position corresponding to the proper engaging portion 58, 60, the side lock plate 76 moves apart from the engaging concave portions 74 of the tumbler plates 66, and connects the sleeve member 22 and the plunger member 42.

As a result, in the lock device 10, the plural tumbler plates 66 are made to engage respectively with the plural engaging portions 58, 60 at the key 12, and the position (the locking position or the unlocking position) of the side lock plate 76 is changed in accordance with the position (the locking position or the unlocking position) of the tumbler pins of the plural tumbler plates 66, and, in accordance with the position of the side lock plate 76, the sleeve member 22 and the plunger member 42 are connected or the connecting of the sleeve member 22 and the plunger member 42 is cancelled. Therefore, because the pitch of the plural tumbler plates 66 can be made to be shorter than the stroke D of the plunger member 42, the dimensions of the plunger member 42 and the key 12 along the axial direction can be made to be short and the dimension of the device along the axial direction can be shortened efficiently, as compared with a lock device in which, for example, plural tumbler pins are made to engage respectively with plural engaged portions at a key, and, in accordance with the positions (the locking positions or the unlocking positions) of the plural tumbler pins, the sleeve member 22 and the plunger member 42 are connected by the respective tumbler pins or the connecting of the sleeve member 22 and the plunger member 42 is cancelled.

Moreover, in the lock device 10, when the proper key 12R is inserted in the key insertion hole 48 and the plunger member 42 starts to move from the standby position toward the operating position, the anchor bars 108 are inserted into the outer peripheral anchor holes 104 against the urging forces of the springs 112 by the pushing force from the outer peripheral surface of the plunger member 42, and restrain the sleeve member 22 at the standby position. In this way, at the time when the plunger member 42 moves from the standby position to the operating position, the sleeve member 22 can be reliably held at the standby position. Accordingly, the sleeve member 22 can be prevented from moving from the standby position toward the operating position due to frictional force from the plunger member 42 or the like, and the operation lever 92 can be reliably swung from the locking position to the unlocking position.

Note that, in the above description relating to the present embodiment, a case is described in which the lock device 10 is applied to a locking mechanism for locking or unlocking an opening/closing member. However, the lock device 10 relating to the present embodiment can be applied to any type of mechanism to be operated, provided that it is a mechanism (a mechanism to be operated) whose operational state is changed by operation of the proper key 12R (a mechanism that changes from one of a non-operating state and an operating state to the other).

Moreover, in the lock device 10, the connecting shaft 96 of the sleeve member 22 is connected to the operation lever 92 so as to be able to rotate relatively, and the pushing shaft 98 of the plunger member 42 is connected to the operation lever 92 so as to be able to rotate relatively. However, it suffices for the pushing shaft 98 of the plunger member 42 to merely press-contact the end surface at the distal end side along the axial direction of the operation lever 92, without the pushing shaft 98 being rotatably connected to the operation lever 92. If the pushing shaft 98 can be made to press-contact the operation lever 92 in this way, the pushing force from the plunger member 42 can be transmitted to the operation lever 92 via the pushing shaft 98, and the operation lever 92 can be made swing toward the unlocking position as the plunger member 42 moves toward the operating position. Further, in this case, because there is no need to allow movement of the connecting shaft 96 along the longitudinal direction of the operation lever 92, it suffices for the connection hole 94 at the operation lever 92 to be a round hole having an inner diameter which corresponds to the outer diameter of the connecting shaft 96.

What is claimed is:

1. A lock device comprising:

a case member which is cylindrical shaped and at whose interior is formed a space extending in an axial direction;

a sleeve member which is cylindrical shaped, and is disposed at the interior of the case member, and is supported by the case member and configured to move along the axial direction between a predetermined standby position and an operating position;

a plunger member which is disposed at an interior of the sleeve member and configured to be able to move along the axial direction, and which is supported by the case member via the sleeve member and configured to be able to move between the standby position and the operating position, and in which a key insertion hole, which is for insertion of a key from an outer side at the standby position, is formed along the axial direction;

a plurality of tumbler members disposed at the plunger member and configured to move along a direction orthogonal to the axial direction between proper positions, which correspond to engaged portions of a proper key at which proper engaged portions are provided, and improper positions, which do not correspond to the engaged portions, and engaging concave portions are formed in peripheral edge portions of the tumbler members, and when a proper key is inserted into the key insertion hole of the plunger member, the tumbler members engage with the engaged portions of the proper key and move to the proper positions, and when an improper key, at which shapes of engaged portions differ from the proper key, is inserted, at least one of the tumbler members is at an improper position;

a side lock member disposed at the plunger member configured to be able to approach and move away from the tumbler members, and when an improper key is inserted in the key insertion hole and at least one of the tumbler members is at the improper position, the side lock member moves apart from the engaging concave portions of the tumbler members and connects the plunger member and the sleeve member along the axial direction, and when a proper key is inserted in the key insertion hole and all of the tumbler members move to the proper positions, the side lock member engages with the engaging concave portions of all of the tumbler members and cancels connection of the plunger member and the sleeve member; and an interlocking mechanism which, at a time when the connection of the plunger member and the sleeve member is cancelled by the side lock member, when the plunger member becomes integral with a proper key and moves to the operating position, transfers pushing force from the plunger member to a mechanism to be operated which is an object of key operation, and causes the mechanism to be operated to operate, and, at a time when the plunger member and the sleeve member are connected together by the side lock member, the interlocking mechanism cuts-off transfer of the pushing force from the plunger member and maintains the mechanism to be operated in a non-operating state, even if the plunger member is integral with the sleeve member and an improper key and moves to the operating position.

2. The lock device of claim 1, further comprising pressing force converting means for, when the plunger member becomes integral with a proper key and moves toward the operating position while the sleeve member remains as is at the standby position, converting a portion of operational force, which is transferred to the plunger member via the proper key, into urging force which urges the side lock member toward the tumbler members.

3. The lock device of claim 1, wherein an outer peripheral anchor hole opens at an inner peripheral surface of the case member, and an accommodating hole is formed so as to pass-through the sleeve member in the direction orthogonal to the axial direction, the accommodating hole coinciding with the outer peripheral anchor hole when the sleeve member is at the standby position, the lock device further comprising:

an anchor member slidably accommodated in the accommodating hole and an outer peripheral side end portion of the anchor member is configured to be inserted into and removed from the outer peripheral anchor hole, and an inner peripheral side end surface of the anchor member is made to abut an outer peripheral surface of the plunger member; and an urging member disposed within the outer peripheral anchor hole, and urging the anchor member toward inside of the sleeve member when the sleeve member is at the standby position, wherein, when a proper key is inserted in the key insertion hole and the plunger member starts to move from the standby position toward the operating position, due to pressing force from the outer peripheral surface of the plunger member, the outer peripheral side end portion of the anchor member is inserted into the outer peripheral anchor hole against urging force from the urging member so that the anchor member restrains the sleeve member at the standby position.

4. The lock device of claim 2, wherein an outer peripheral anchor hole opens at an inner peripheral surface of the case member, and an accommodating hole formed so as to pass-through the sleeve member in the direction orthogonal to the axial direction, the accommodating hole coinciding with the outer peripheral anchor hole when the sleeve member is at the standby position, the lock device further comprising:

an anchor member slidably accommodated in the accommodating hole, and an outer peripheral side end portion of the anchor member is configured to be inserted into and removed from the outer peripheral anchor hole, and an inner peripheral side end surface of the anchor member is made to abut an outer peripheral surface of the plunger member; and an urging member disposed within the outer peripheral anchor hole, and urging the anchor member toward an inner peripheral side when the sleeve member is at the standby position, wherein, when a proper key is inserted in the key insertion hole and the plunger member starts to move from the standby position toward the operating position, due to pressing force from the outer peripheral surface of the plunger member, the outer peripheral side end portion of the anchor member being inserted into the outer peripheral anchor hole against urging force from the urging member so that the anchor member restrains the sleeve member at the standby position.

* * * * *